US007010239B2

(12) United States Patent
Gross et al.

(10) Patent No.: US 7,010,239 B2
(45) Date of Patent: Mar. 7, 2006

(54) APPARATUS AND METHOD FOR CLEANING A DONOR ROLL

(75) Inventors: Eric M. Gross, Rochester, NY (US); Paul J. McConville, Webster, NY (US); Gerald S. Leclerc, Webster, NY (US); Joseph A. Mastrandrea, Webster, NY (US); Mark J. Hirsch, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 55 days.

(21) Appl. No.: 10/696,123

(22) Filed: Oct. 29, 2003

(65) Prior Publication Data

US 2005/0095024 A1 May 5, 2005

(51) Int. Cl.
*G03G 15/06* (2006.01)
*G03G 15/08* (2006.01)

(52) U.S. Cl. ..... 399/55; 399/285

(58) Field of Classification Search ..... 399/53, 399/55, 98, 99, 222, 252, 265, 266, 270, 399/285, 290, 291, 273, 283
See application file for complete search history.

(56) References Cited

U.S. PATENT DOCUMENTS 5,341,197 A * 8/1994 Folkins et al. ..... 399/273
5,420,375 A * 5/1995 Folkins et al. ..... 399/270
5,512,981 A 4/1996 Hirsch
6,049,686 A * 4/2000 Folkins et al. ..... 399/266

* cited by examiner

*Primary Examiner*—Sandra L. Brase
(74) *Attorney, Agent, or Firm*—Lloyd F. Bean, II

(57) ABSTRACT

An apparatus for developing a latent image recorded on a movable imaging surface, including: a reservoir for storing a supply of developer material including toner particles, said reservoir including a transport member; a donor member being arranged to receive toner particles from said transport member and to deliver toner particles to the image surface at locations spaced apart from each other in the direction of movement of the imaging surface thereby to develop the latent image thereon; a power supply, connected to said donor member, for biasing said donor member to deliver toner to the image surface during a printing mode of operation; a second power supply, connected to the transport member, for maintaining a predefined voltage difference between the transport member and the donor member such that toner particles are attracted to the donor member from the transport member during a printing mode of operation; a controller for generating a donor member purge signal trigger based on sensed or calculated development conditions; and a power supply controller, responsive to said donor member purge signal, for changing the voltage between the donor member and the transport member during a second mode of operation thereby causing toner to partially or completely transfer back to said transport member and optionally transported to the imaging surface.

6 Claims, 5 Drawing Sheets

APPARATUS AND METHOD FOR CLEANING A DONOR ROLL

This invention relates to an apparatus for maintaining print quality in xerographic development systems by employing an occasional reverse bias donor roll cleaning cycle.

Generally, the process of electrophotographic printing includes charging a photoconductive member to a substantially uniform potential to sensitize the photoconductive surface thereof. The charged portion of the photoconductive surface is exposed to a light image from either a scanning laser beam, a light emitting diode (LED) source, or an original document being reproduced. This records an electrostatic latent image on the photoconductive surface. After the electrostatic latent image is recorded on the photoconductive surface, the latent image is developed. Two-component and single-component developer materials are commonly used for development. A typical two-component developer comprises magnetic carrier granules having toner particles adhering triboelectrically thereto. A single-component developer material typically comprises toner particles. Toner particles are attracted to the latent image, forming a toner powder image on the photoconductive surface. The toner powder image is subsequently transferred to a copy sheet. Finally, the toner powder image is heated to permanently fuse it to the copy sheet in image configuration.

The electrophotographic marking process given above can be modified to produce color images. One color electrophotographic marking process, called image-on-image (IOI) processing, superimposes toner powder images of different color toners onto a photoreceptor prior to the transfer of the composite toner powder image onto a substrate. While the IOI process provides certain benefits, such as a compact architecture, there are several challenges to its successful implementation. For instance, the viability of printing system concepts, such as IOI processing, require development systems that do not interact with a previously toned image. Since several known development systems, such as conventional magnetic brush development and jumping single-component development, interact with the image on a receiver, a previously toned image will be scavenged by subsequent development if interacting development systems are used. Thus, for the IOI process, there is a need for scavengeless or noninteractive development systems.

Hybrid scavengeless development (HSD) technology develops toner via a conventional magnetic brush onto the surface of a donor roll and a plurality of electrode wires are closely spaced from the toned donor roll in a development zone. An AC voltage is applied to the wires to generate a toner cloud in the development zone. The donor roll generally consists of a conductive core covered with a thin (50–200 .um) partially conductive layer. The donor roll is held at an electrical potential difference relative to the magnetic brush to produce the field necessary to load toner onto the donor roll. The toner layer on the donor roll is then disturbed by electric fields from a wire or set of wires to produce and sustain an agitated cloud of toner particles. Typical AC voltages of the wires relative to the donor roll are 700–900 Vpp at frequencies of 5–15 kHz. These AC signals are often square waves, rather than pure sinusoidal waves. Toner from the cloud is then developed onto a nearby photoreceptor by fields created by a latent image.

A problem with developer systems is that under certain customer usage conditions it is not possible to maintain solid area density. The problematic customer usage condition is sustained running at low area coverage (<3%) and is exacerbated by low humidity. The root cause of the developability fall off is not understood at this time. Various hypothesis have been put forward such as material fines accumulation on the donor roll and increased toner adhesion to the donor roll among others.

Though the cause of developability fall off is not understood, this invention proposes the use of an occasional reverse bias donor roll cleaning cycle, to maintain print quality in xerographic development systems that use donor rolls, such as HSD as practiced in IGEN3® or Hybrid Jumping Development (HJD) as practiced in the DC 460–DC490 family of products. When such systems are run with little or no toner throughput, toner on the roll becomes difficult to remove due to increased electrostatic and adhesion forces. This invention proposes the temporary use of a reverse bias, from say +70 volts to −100 volts to totally or partially clean the donor roll, and drive the toner back to the magnetic brush. This allows the donor to be refreshed, and returns print quality to nominal. Additionally, while the donor toner is being returned to the magnetic brush, an appropriate electric field may be established between the donor and the photoreceptor to develop some toner to the photoreceptor and, hence, to be removed from the developer housing.

There is provided an apparatus for developing a latent image recorded on a movable imaging surface, including: a reservoir for storing a supply of developer material including toner particles, said reservoir including a transport member; a donor member being arranged to receive toner particles from said transport member and to deliver toner particles to the image surface at locations spaced apart from each other in the direction of movement of the imaging surface thereby to develop the latent image thereon; a power supply, connected to said donor member, for biasing said donor member to deliver toner to the image surface during a printing mode of operation; a second power supply, connected to the transport member, for maintaining a predefined voltage difference between the transport member and the donor member such that toner particles are attracted to the donor member from the transport member during a printing mode of operation; a controller for generating a donor member purge signal trigger based on sensed or calculated development conditions; and a power supply controller, responsive to said donor member purge signal, for changing the voltage between the donor member and the transport member during a second mode of operation thereby causing toner to partially or completely transfer back to said transport member and, optionally, transported to the imaging surface.

While the system will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims. For example, even though the example given is a color process employing Image-On-Image technology, the invention is applicable to any system having donor rolls that are loaded by a magnetic brush, such as monochrome systems using just DC or AC/DC voltages to develop toner to the photoreceptor.

Other features of the present invention will become apparent as the following description proceeds and upon reference to the drawings, in which.

Figure 1:
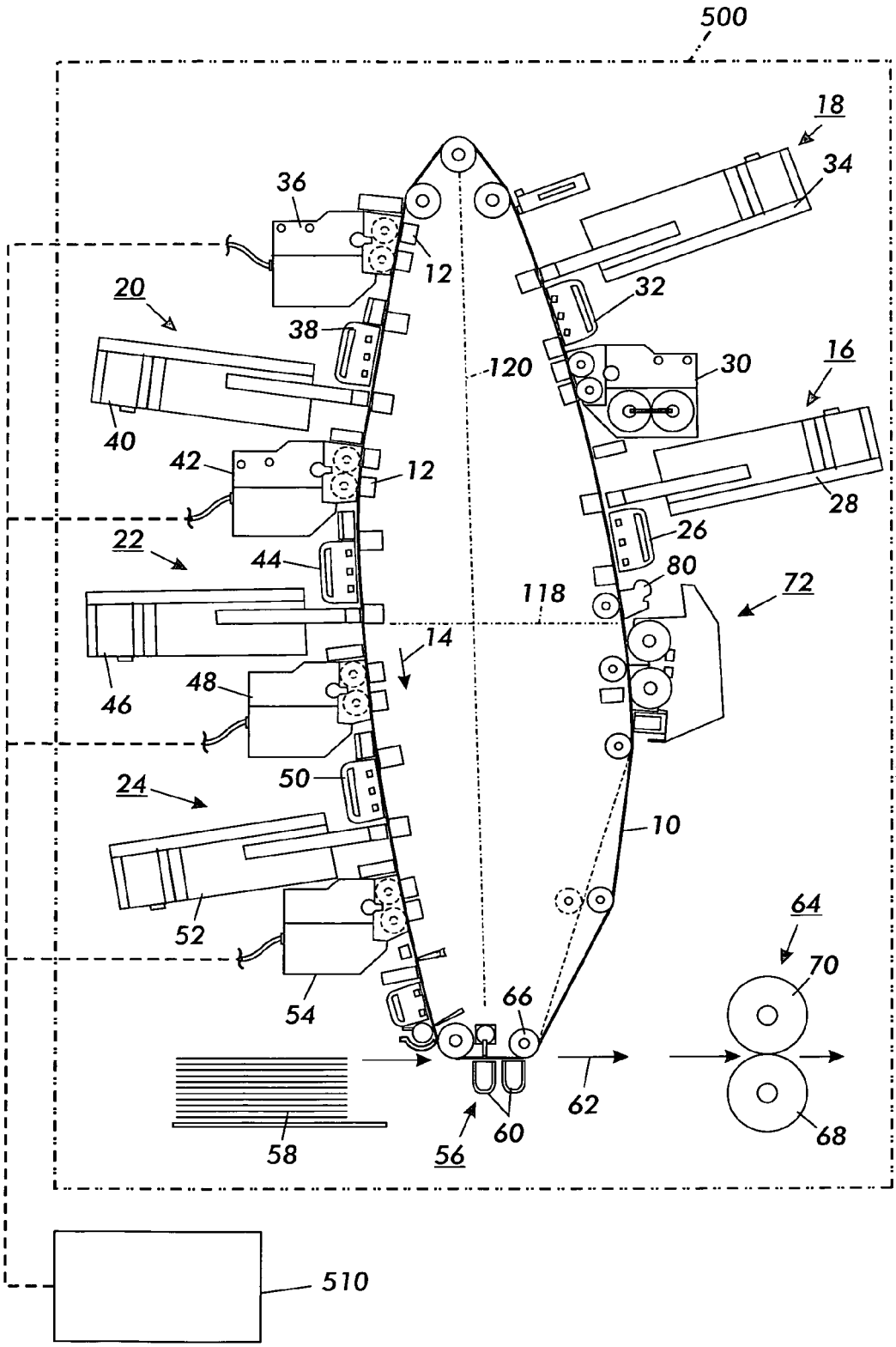
FIG. 1 is a schematic illustration of a printing apparatus incorporating the inventive features of the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the system, reference is made to the drawings. In the drawings, like reference numerals have been used throughout to designate identical elements.

Referring now to the drawings, there is shown a single pass multi-color printing machine in FIG. 1. This printing machine employs the following components: a photoconductive belt 10, supported by a plurality of rollers or bars, 12. Photoconductive belt 10 is arranged in a vertical orientation. Photoconductive belt 10 advances in the direction of arrow 14 to move successive portions of the external surface of photoconductive belt 10 sequentially beneath the various processing stations disposed about the path of movement thereof. The photoconductive belt 12 has a major axis 120 and a minor axis 118. The major and minor axes 120, 118 are perpendicular to one another. Photoconductive belt 10 is elliptically shaped. The major axis 120 is substantially parallel to the gravitational vector and arranged in a substantially vertical orientation. The minor axis 118 is substantially perpendicular to the gravitational vector and arranged in a substantially horizontal direction. The printing machine architecture includes five image recording stations indicated generally by the reference numerals 16, 18, 20, 22, and 24, respectively. Initially, photoconductive belt 10 passes through image recording station 16. Image recording station 16 includes a charging device and an exposure device. The charging device includes a corona generator 26 that charges the exterior surface of photoconductive belt 10 to a relatively high, substantially uniform potential. After the exterior surface of photoconductive belt 10 is charged, the charged portion thereof advances to the exposure device. The exposure device includes a raster output scanner (ROS) 28, which illuminates the charged portion of the exterior surface of photoconductive belt 10 to record a first electrostatic latent image thereon. Alternatively, a LED may be used.

This first electrostatic latent image is developed by developer unit 30. Developer unit 30 deposits toner particles of a selected color on the first electrostatic latent image. After the highlight toner image has been developed on the exterior surface of photoconductive belt 10, photoconductive belt 10 continues to advance in the direction of arrow 14 to image recording station 18.

Image recording station 18 includes a recharging device and an exposure device. The charging device includes a corona generator 32 which recharges the exterior surface of photoconductive belt 10 to a relatively high, substantially uniform potential. The exposure device includes a ROS 34 which illuminates the charged portion of the exterior surface of photoconductive belt 10 selectively to record a second electrostatic latent image thereon. This second electrostatic latent image corresponds to the regions to be developed with magenta toner particles. This second electrostatic latent image is now advanced to the next successive developer unit 36.

Developer unit 36 deposits magenta toner particles on the electrostatic latent image. In this way, a magenta toner powder image is formed on the exterior surface of photoconductive belt 10. After the magenta toner powder image has been developed on the exterior surface of photoconductive belt 10, photoconductive belt 10 continues to advance in the direction of arrow 14 to image recording station 20.

Image recording station 20 includes a charging device and an exposure device. The charging device includes corona generator 38, which recharges the photoconductive surface to a relatively high, substantially uniform potential. The exposure device includes ROS 40 which illuminates the charged portion of the exterior surface of photoconductive belt 10 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of photoconductive belt 10 to form a yellow toner powder image thereon. After the third electrostatic latent image has been developed with yellow toner, photoconductive belt 10 advances in the direction of arrow 14 to the next image recording station 22.

Image recording station 22 includes a charging device and an exposure device. The charging device includes a corona generator 44, which charges the exterior surface of photoconductive belt 10 to a relatively high, substantially uniform potential. The exposure device includes ROS 46, which illuminates the charged portion of the exterior surface of photoconductive belt 10 to selectively dissipate the charge on the exterior surface of photoconductive belt 10 to record a fourth electrostatic latent image for development with cyan toner particles. After the fourth electrostatic latent image is recorded on the exterior surface of photoconductive belt 10, photoconductive belt 10 advances this electrostatic latent image to the cyan developer unit 48.

Developer unit 48 deposits cyan toner particles on the fourth electrostatic latent image. These toner particles may be partially in superimposed registration with the previously formed powder image. After the cyan toner powder image is formed on the exterior surface of photoconductive belt 10, photoconductive belt 10 advances to the next image recording station 24.

Image recording station 24 includes a charging device and an exposure device. The charging device includes corona generator 50 which charges the exterior surface of photoconductive belt 10 to a relatively high, substantially uniform potential. The exposure device includes ROS 52, which illuminates the charged portion of the exterior surface of photoconductive belt 10 to selectively discharge those portions of the charged exterior surface of photoconductive belt 10 which are to be developed with black toner particles. The fifth electrostatic latent image, to be developed with black toner particles, is advanced to black developer unit 54.

At black developer unit 54, black toner particles are deposited on the exterior surface of photoconductive belt 10. These black toner particles form a black toner powder image which may be partially or totally in superimposed registration with the previously formed toner powder images. In this way, a multi-color toner powder image is formed on the exterior surface of photoconductive belt 10. Thereafter, photoconductive belt 10 advances the multi-color toner powder image to a transfer station, indicated generally by the reference numeral 56.

At transfer station 56, a receiving medium, i.e., paper, is advanced from stack 58 by sheet feeders and guided to transfer station 56. At transfer station 56, a corona generating device 60 sprays ions onto the backside of the paper. This attracts the developed multi-color toner image from the exterior surface of photoconductive belt 10 to the sheet of paper. Stripping assist roller 66 contacts the interior surface of photoconductive belt 10 and provides a sufficiently sharp bend thereat so that the beam strength of the advancing paper strips from photoconductive belt 10. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 10. The photoconductive belt 10 moves over isolation roller 78 which isolates the cleaning operation at cleaning station 72. At cleaning station 72, the residual toner particles are removed from photoconductive belt 10. Photoconductive belt 10 then moves under spots blade 80 to also remove toner particles therefrom. Environmental conditioning unit 510 maintains the printing machine components enclosed in enclosure 500 at a predefine temperature and humidity.

Figure 2:
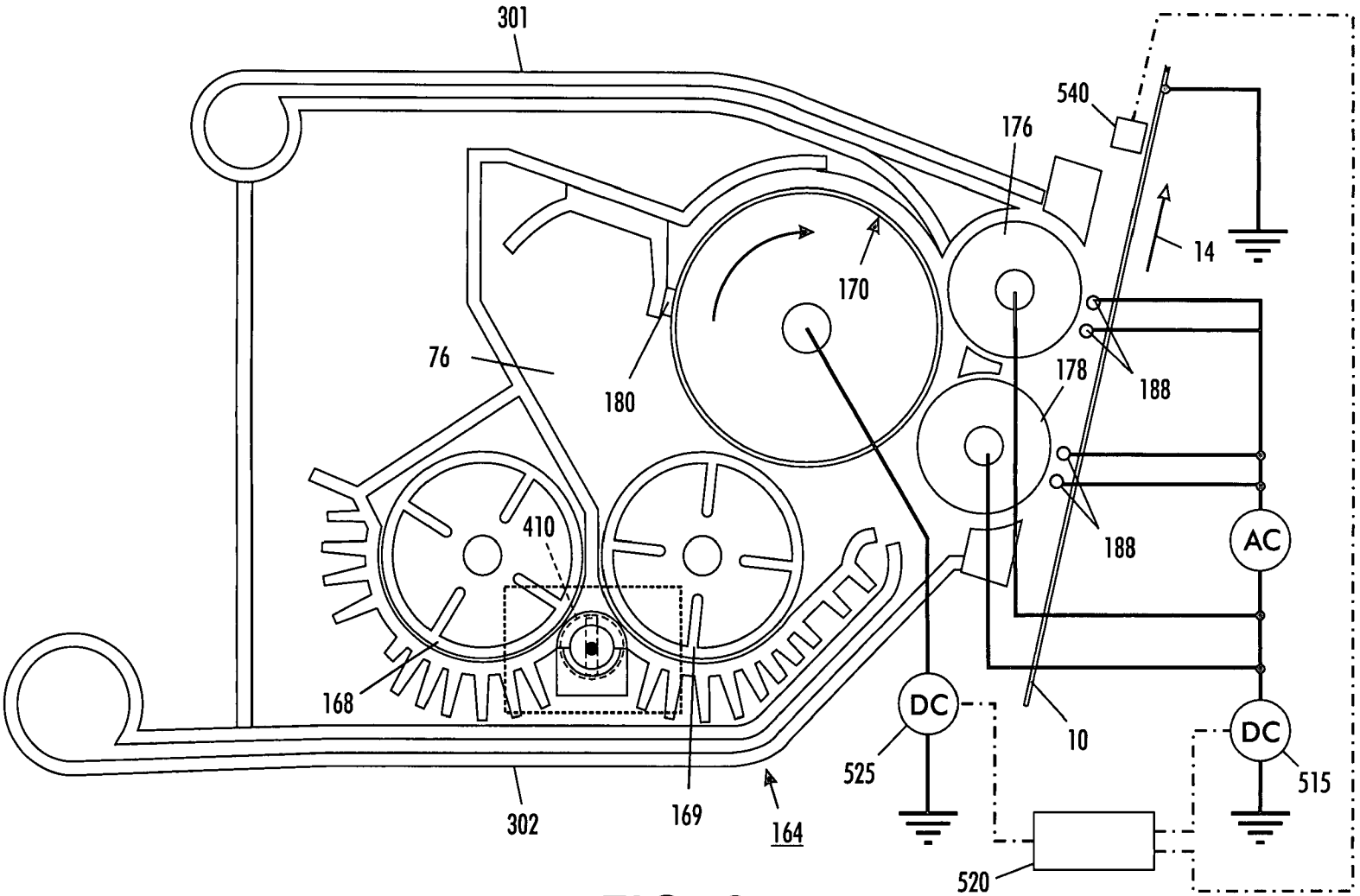
FIG. 2 is a schematic illustration of a development station incorporating the present invention.

Referring now to FIG. 2, there are shown the details of a development apparatus. The apparatus comprises a reservoir or developing housing 164 containing developer material. The developer material is of the two component type, that is it comprises carrier granules and toner particles. The reservoir 164 includes augers 168, which are rotatably-mounted in the reservoir chamber. The augers 168 and 169 serve to transport and to agitate the developer material within the reservoir 164 and encourage the toner particles to adhere triboelectrically to the carrier granules. A magnetic brush roll 170 transports developer material from the reservoir 164 to loading nips of two donor rolls or members 176 and 178. Magnetic brush rolls are well known, so the construction of magnetic brush roll 170 need not be described in great detail. Briefly the magnetic brush roll 170 comprises a rotatable tubular housing within which is located a stationary magnetic cylinder having a plurality of magnetic poles impressed around its surface. The carrier granules of the developer material are magnetic and, as the tubular housing of the magnetic brush roll 170 rotates, the granules (with toner particles adhering triboelectrically thereto) are attracted to the magnetic brush roll 170 and are conveyed to the donor roll loading nips. A metering blade 180 removes excess developer material from the magnetic brush roll 170 and ensures an even depth of coverage with developer material before arrival at the first donor roll loading nip. At each of the donor roll loading nips toner particles are transferred from the magnetic brush roll 170 to the respective donor rolls 176 and 178.

Each donor roll 176 and 178 transports the toner to a respective development zone through which the photoconductive belt 10 passes. Transfer of toner from the magnetic brush roll 170 to the donor rolls 176 and 178 can be encouraged by, for example, the application of a suitable D.C. electrical bias to the magnetic brush roll 170 and/or donor rolls 176 and 178. The D.C. bias (for example, approximately 100 v applied to the magnetic brush roll 170) establishes an electrostatic field between the magnetic brush roll 170 and donor rolls 176 and 178, which causes toner particles to be attracted to the donor rolls 176 and 178 from the carrier granules on the magnetic brush roll 170.

The carrier granules and any toner particles that remain on the magnetic brush roll 170 are returned to the reservoir 164 as the magnetic brush roll 170 continues to rotate. The relative amounts of toner transferred from the magnetic brush roll 170 to the donor rolls 176 and 178 can be adjusted, for example by: applying different bias voltages, including AC voltages, to the donor rolls 176 and 178; adjusting the magnetic brush roll to donor roll spacing; adjusting the strength and shape of the magnetic field at the loading nips and/or adjusting the speeds of the donor rolls 176 and 178.

At each of the development zones, toner is transferred from the respective donor rolls 176 and 178 to the latent image on the photoconductive belt 10 to form a toner powder image on the latter. Various methods of achieving an adequate transfer of toner from a donor roll to a photoconductive surface are known and any of those may be employed at the development zones.

In FIG. 2, each of the development zones is shown as having the form i.e. electrode wires 188 are disposed in the space between each donor roll 176 and 178 and photoconductive belt 10. FIG. 2 shows, for each donor roll 176 and 178 a respective pair of electrode wires 188 extending in a direction substantially parallel to the longitudinal axis of the donor rolls 176 and 178. The electrode wires 188 are made from thin (i.e. 50 to 100 .mu. diameter) wires which are closely spaced from the respective donor rolls 176 and 178. With no voltage between a wire and a donor roll, the distance between each electrode wire 188 and the respective donor rolls 176 and 178 is within the range from about 10 .mu. to about 40 .mu. (typically approximately 25 .mu.)To this end the extremities of the electrode wires 188 are supported by the tops of end bearing blocks that also support the donor rolls 176 and 178 for rotation. The electrode wires 188 extremities are attached so that they are slightly above a tangent to the surface, including the toner layer, of the donor rolls 176 and 178. An alternating electrical bias is applied to the electrode wires 188 by an AC voltage source. When a voltage difference exists between the wires and donor rolls, the electrostatic attraction clamps the wires to the surface of the toner layer.

The applied AC establishes an alternating electrostatic field between each pair of electrode wires 188 and the respective donor rolls 176 and 178, which is effective in detaching toner from the surface of the donor rolls 176 and 178 and forming a toner cloud about the electrode wires 188, the height of the cloud being such as not to be substantially in contact with the photoconductive belt 10. The magnitude of the AC voltage is on the order of 200 to 500 volts peak at a frequency ranging from about 5 kHz to about 15 kHz. This applied voltage of 200 to 500 volts produces a relatively large electrostatic field without risk of air breakdown.

A DC and AC bias supply (not shown) applied to each donor roll 176 and 178 establishes electrostatic fields between the photoconductive belt 10 and donor rolls 176 and 178 for attracting the detached toner particles from the clouds surrounding the electrode wires 188 to the latent image recorded on the photoconductive surface of the photoconductive belt 10.

As successive electrostatic latent images are developed, the toner particles within the developer material are depleted. A toner dispenser (not shown) stores a supply of toner particles. The toner dispenser is in communication with reservoir 164 and, as the concentration of toner particles in the developer material is decreased, fresh toner particles are furnished to the developer material in the reservoir 164. The augers 168 in the reservoir chamber mix the fresh toner particles with the remaining developer material so that the resultant developer material therein is substantially uniform. In this way, a substantially constant amount of toner particles is in the reservoir 164 with the toner particles having a constant charge.

In the arrangement shown in FIG. 2, the donor rolls 176 and 178 and the magnetic brush roll 170 can be rotated either "with" or "against" the direction of motion of the photoconductive belt 10. The two-component developer used in the apparatus of FIG. 2 may be of any suitable type. However, the use of an electrically conductive developer is preferred because it eliminates the possibility of charge build-up within the developer material on the magnetic brush roll 170 which, in turn, could adversely affect development at the second donor roll 178. By way of example, the carrier granules of the developer material may include a ferromagnetic core having a thin layer of magnetite overcoated with a non-continuous layer of resinous material. The toner particles may be made from a resinous material, such as a vinyl polymer, mixed with a coloring material, such as chromogen black. The developer material may comprise from about 95% to about 99% by weight of carrier and from 5% to about 1% by weight of toner.

The developer housing employs a system to control toner emission which is composed of two manifolds 301 and 302. The location of the two manifolds are placed above and below the upper and lower donor rolls respectively. The manifolds are mounted in a position to improve emissions control as well as reductions in the flow needed to accomplish the task.

The system includes a controller 520 to switch the polarity and magnitude of power supplies 515 and 525. Controller 520 employs digital value corresponding to the analog measurements are processed in conjunction with a Non-Volatile Memory (NVM) by firmware forming a part of the control board (not shown). The digital values arrived at are converted by a digital to analog (D/A) converter for use in controlling the ROS, dicorotrons and power supplies 515 and 525. Toner dispensers are controlled by the digital values. Target values for use in setting and adjusting the operation of the active machine components are stored in NVM.

Applicants have found that the use of an occasional reverse bias donor roll cleaning or purging cycle, maintains print quality in xerographic development systems that use donor rolls, such as Hybrid Scavengeless Development. When such systems are run with little or no toner throughput, toner on the roll becomes difficult to remove due to increased electrostatic and adhesion forces and developability becomes difficult to control, even with increased development fields. Applicants have found that the temporary use of a reverse bias, from say +70 volts to −100 volts, totally or partially cleans the donor roll, and drives the toner back into the magnetic brush. Proper choice of the donor bias relative to the photoconductor bias would also allow some of the donor toner to be developed to the photoreceptor and, hence, to exit the developer system. Subsequent return of the donor bias to its normal operating level allows a fresh toner layer to be deposited by the magnetic brush. This allows the donor to be refreshed, and returns print quality to nominal.

Controller 520 enables a change in Vdm from a nominal value to a specified voltage level for a specified duration. For example in a IGEN3® color printer manufactured by Xerox Corporation, Vdm is normally set to 70 volts to enable the development of toner from the magnetic roll to the donor roll. This is required to replenish the toner that is developed from the donor roll to the photoreceptor. By reversing the Vdm voltage from 70 volts to a lesser value (for our experiments −100 volts was used) the toner is developed back from the donor roll to the magnetic roll. Furthermore, during this process some toner on the donor roll could be developed to the photoreceptor and exit the system via the cleaner.

Applicants have also found that the system provides an option of rendering an image on the photoreceptor when the Vdm bias is reversed to assist in developing material off the donor roll to the photoreceptor. This may be desirable since it purges from the system the poor developing material that adheres to the donor roll. This is particularly important if the development loss problem is the result of the accumulation in the housing of a poor developing species of toner that will get purged during the reverse bias donor roll cleaning cycle.

In the experimental implementation, when the Vdm bias is switched a photoreceptor pitch is skipped. Otherwise the customer image will be affected. Eventually this feature could occur in the photoreceptor seam zone area, eliminating the need to skip a pitch. The frequency of the reverse bias donor roll cleaning cycle (how often to reverse the bias), the voltage level to which it is switched, and the duration, could be settable parameters in NVM. The frequency can be adjusted in real time by a feedback controller on the basis of whether or not the bias reversal has any impact on development (as measured by, e.g., a toner density sensor 540). The Vdm feature can be disabled per separation by NVM. When enabled, the Vdm blipping will occur during cycle up convergence, run time, and during any machine maintenance mode. Experimentally the feature was run at a rate of once per two belt revolutions, and the Vdm bias is changed from 70 volts nominal to −100 volts for a duration of 131 ms. The 131 ms duration is the time for one complete donor roll revolution. Below is an example of a software routine that can be run on an Igen3 which illustrates features of the present invention.

Routine Description:

If any of VdmBurstEnable1, 2, 3, 4 is true then request a skip pitch every VdmBurstPeriodOfOccurence units (in units of belt revs). [Following completion of the burst cycle read in a new value of VdmBurstPeriodOf-Occurence as this value may be subject to change by a future rate scheduling requirement].

When the skip pitch arrives at the M development station and if VdmBurstCycleEnable1==True:

If (RosLevelDuringVdmBurstEnable1==True), render an image (DAC can be set from a config file) that will appear before the doner rolls during Vdm blip. This will enhance development to the photoconductive surface during the reverse bias donor roll cleaning cycle.

Set Vdm from nominal value (NVM of 70 v) to VdmBurstLevel1. Keep at this value for a duration of VdmBurstDuration1. After duration is complete set Vdm back to nominal value.

When the skip pitch arrives at the Y development station and if VdmBurstCycleEnable2==True: {Repeat above description for station 2}.

When the skip pitch arrives at the C development station and if VdmBurstCycleEnable3==True:

{Repeat above description for station 3}.

When the skip pitch arrives at the K development station and if VdmBurstCycleEnable4==True: {Repeat above description for station 4}.

Figure 3:
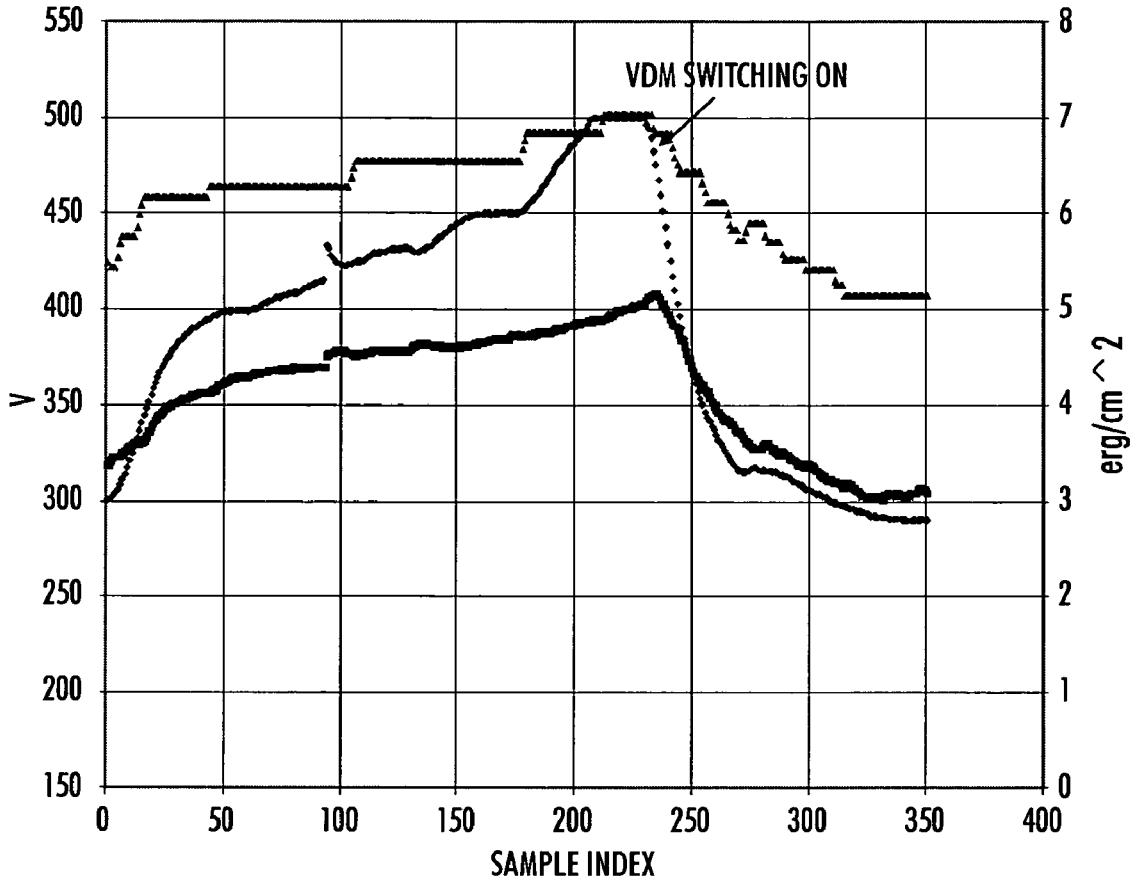
FIGS. 3–5 is experimental data of a printing machine employing the present invention.
Figure 4:
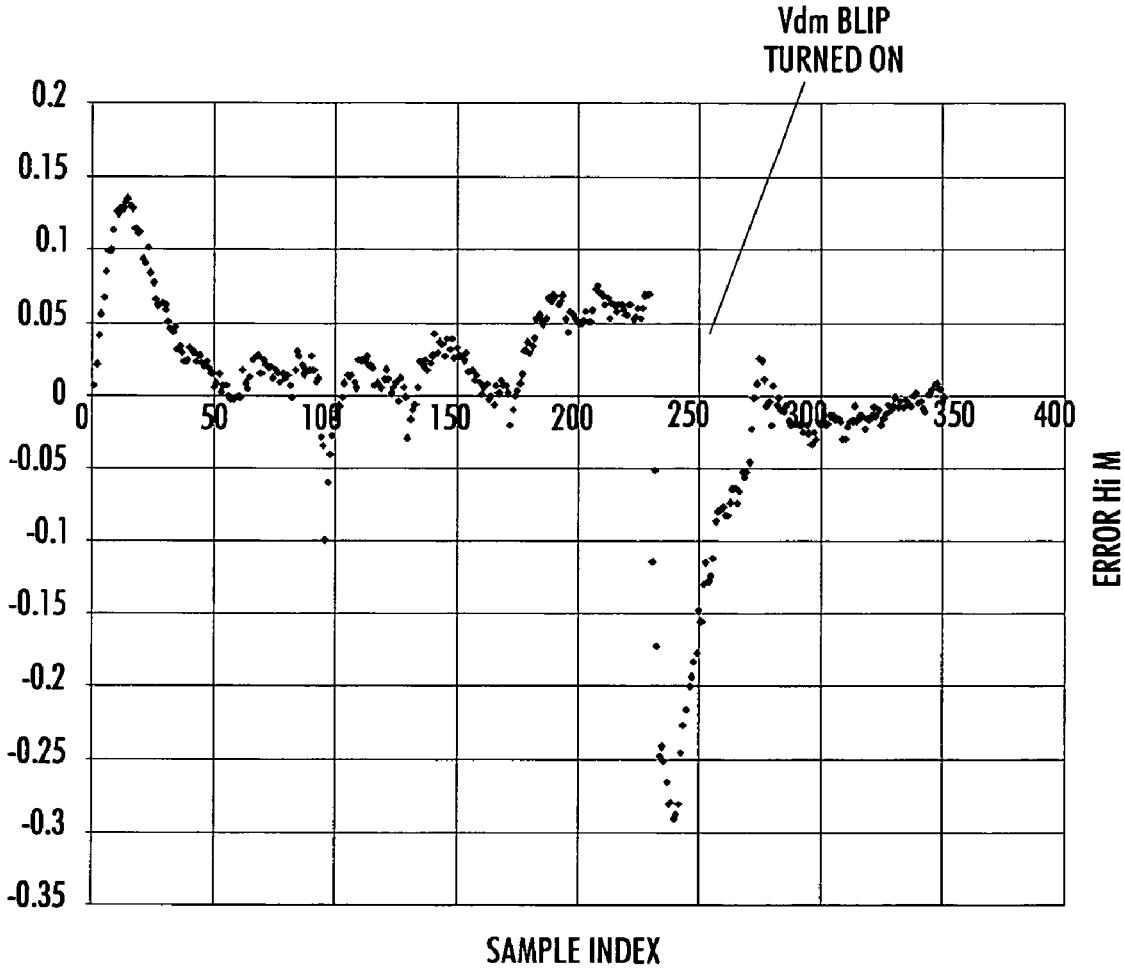
Figure 5:
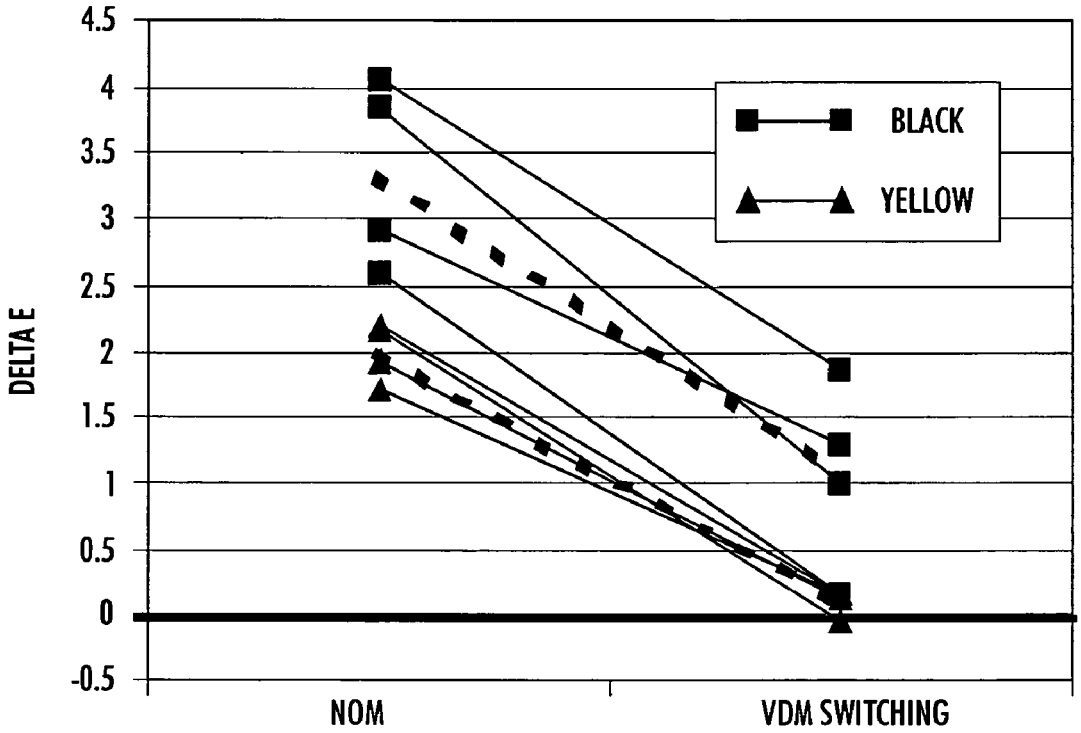

Applicants have found that the effect of the Vdm blip on development is dramatic. Below are the actuator tracks for a low area coverage run (typically a stress for IGen3 materials) of 2% for magenta material. The Vmag actuator is railed at a maximum value of 500 volts. After Vdm blipping is enabled mid run the rate of development recovery exceeds (See plot of ETAC density sensor tracks) the process controls tracking bandwidth (normally Vdm blip will occur periodically to prevent such a large transient). Runs of over 100000 prints at 2% area coverage have been made with relatively small variations in development field (Vmag levels have varied as M:+−56 volts, Y:+−81 volts, C:+−62 volts, K+−24 volts) required to maintain solid area development as shown in FIGS. 3, 4, and 5.

In recapitulation, there is provided an apparatus for developing a latent image recorded on a movable imaging surface, including: a reservoir for storing a supply of developer material including toner particles, said reservoir including a transport member; a donor member being arranged to receive toner particles from said transport member and to deliver toner particles to the image surface at locations spaced apart from each other in the direction of movement of the imaging surface thereby to develop the latent image thereon; a power supply, connected to said donor member, for biasing said donor member to deliver toner to the image surface during a printing mode of operation; a second power supply, connected to the transport member, for maintaining a predefined voltage difference between the transport member and the donor member such that toner particles are attracted to the donor member from the transport member during a printing mode of operation; a controller for generating a donor member purge signal trigger based on sensed or calculated development conditions; and a power supply controller, responsive to said donor member purge signal, for changing the voltage between the donor member and the transport member during a second mode of operation thereby causing toner to partially or completely transfer back to said transport member or optionally transported to the imaging surface.

The invention has been described in detail with particular reference to a preferred embodiment thereof, but it will be understood that variations and modifications can be effected within the spirit and scope of the invention as described hereinabove and as defined in the appended claims.

The invention claimed is:

1. An apparatus for developing a latent image recorded on a movable imaging surface, including:

a reservoir for storing a supply of developer material including toner particles, said reservoir including a transport member;

a donor member being arranged to receive toner particles from said transport member and to deliver toner particles to the image surface at locations spaced apart from each other in the direction of movement of the imaging surface thereby to develop the latent image thereon;

a power supply, connected to said donor member, for biasing said donor member to deliver toner to the image surface during a printing mode of operation;

a second power supply, connected to the transport member, for maintaining a predefined voltage difference between the transport member and the donor member such that toner particles are attracted to the donor member from the transport member during a printing mode of operation;

means for generating a donor member purge signal trigger based on sensed or calculated development conditions; and a power supply controller, responsive to said donor member purge signal, for changing the voltage between the donor member and the transport member during a second mode of operation thereby causing toner to partially or completely transfer back to said transport member or optionally transported to the imaging surface, said generating means includes either automatically adjusted or settable parameters that can be made the outcome of an algorithm that has as input development conditions and development response to the reverse bias donor roll cleaning cycle.

2. An apparatus for developing a latent image recorded on a movable imaging surface, including:

a reservoir for storing a supply of developer material including toner particles, said reservoir including a transport member;

a donor member being arranged to receive toner particles from said transport member and to deliver toner particles to the image surface at locations spaced apart from each other in the direction of movement of the imaging surface thereby to develop the latent image thereon;

a power supply, connected to said donor member, for biasing said donor member to deliver toner to the image surface during a printing mode of operation;

a second power supply, connected to the transport member, for maintaining a predefined voltage difference between the transport member and the donor member such that toner particles are attracted to the donor member from the transport member during a printing mode of operation;

means for generating a donor member purge signal trigger based on sensed or calculated development conditions; and a power supply controller, responsive to said donor member purge signal, for changing the voltage between the donor member and the transport member during a second mode of operation thereby causing toner to partially or completely transfer back to said transport member and optional optionally transported to the imaging surface and, the donor member purge signal is triggered by detectors that sense development conditions.

3. The apparatus of claim 2, wherein said power supplies apply a bias between donor member and transport member having a dc component between +30 and +200 during said printing mode of operation, and where a positive sign of bias is defined such that toner particles are attracted to the donor member from the transport member.

4. The apparatus of claim 2, wherein, during the purging mode of operation, said power supplies apply a bias between the donor member and the transport member having a dc component that is less than or equal to the dc bias used during the printing mode of operation, and where a positive sign of bias is defined such that toner particles are attracted to the donor member from the transport member.

5. The apparatus of claim 2, wherein said purging mode of operation is enabled during one or more periods selected from the group consisting of cycle up convergence, run time, and machine adjustment mode.

6. The apparatus of claim 2, wherein said purging mode is initiated once per 10 to 200 donor member revolutions.

* * * * *